US008943632B2

(12) United States Patent
Bernini

(10) Patent No.: US 8,943,632 B2
(45) Date of Patent: Feb. 3, 2015

(54) APPARATUS FOR CLEANING SWIMMING POOLS

(71) Applicant: Fabrizio Bernini, Bucine (IT)

(72) Inventor: Fabrizio Bernini, Bucine (IT)

( * ) Notice: Subject to any disclaimer, the term of this patent is extended or adjusted under 35 U.S.C. 154(b) by 0 days.

(21) Appl. No.: 13/690,377

(22) Filed: Nov. 30, 2012

(65) Prior Publication Data

US 2013/0318728 A1 Dec. 5, 2013

(30) Foreign Application Priority Data

May 30, 2012 (EP) ..... 12425101

(51) Int. Cl.
*E04H 4/16* (2006.01)

(52) U.S. Cl.
CPC ..... *E04H 4/1654* (2013.01)
USPC .... 15/1.7; 210/167.1; 210/167.16; 210/416.2

(58) Field of Classification Search
CPC ..... E04H 4/1654; E04H 4/16
USPC ..... 15/1.7; 210/167.1, 167.16, 416.2; 241/101.74, 101.742, 173
See application file for complete search history.

(56) References Cited

U.S. PATENT DOCUMENTS 6,039,886 A * 3/2000 Henkin et al. ..... 210/776
6,090,219 A * 7/2000 Henkin et al. ..... 134/18
6,122,794 A * 9/2000 Atkins ..... 15/246
6,294,084 B1 * 9/2001 Henkin et al. ..... 210/143
6,387,250 B1 * 5/2002 Henkin et al. ..... 210/97
6,485,638 B2 * 11/2002 Henkin et al. ..... 210/143
6,886,205 B1 * 5/2005 Pichon ..... 15/1.7
6,942,790 B1 * 9/2005 Dolton ..... 210/167.16
7,037,038 B1 * 5/2006 Haski et al. ..... 405/60
7,690,066 B2 * 4/2010 Stoltz et al. ..... 15/1.7
7,721,370 B2 * 5/2010 Gopalan ..... 15/1.7
7,786,381 B2 * 8/2010 Henkin et al. ..... 174/68.1
7,908,696 B2 * 3/2011 Pareti ..... 15/1.7
8,141,191 B2 * 3/2012 Hui ..... 15/1.7
8,252,176 B2 * 8/2012 Hui ..... 210/167.16
8,273,183 B2 * 9/2012 Erlich et al. ..... 134/6

(Continued)

FOREIGN PATENT DOCUMENTS

EP 1207594 A2 5/2002
EP 1785552 A2 5/2007

OTHER PUBLICATIONS

Extended European Search Report issued in European Patent Application No. 12425101.8 dated Jan. 23, 2013.

*Primary Examiner* — Monica Carter
*Assistant Examiner* — Michael Jennings
(74) *Attorney, Agent, or Firm* — Lucas & Mercanti, LLP

(57) ABSTRACT

An apparatus for cleaning swimming pools comprises a self-propelled device comprising: movement means for moving the self-propelled device in a swimming pool; a water recirculation circuit; means for cleaning the surfaces of the swimming pool; and a power supply battery for supplying electric energy to one or more out of the movement means, the recirculation circuit and the cleaning means; the apparatus also comprises a recharging base for the power supply battery, the base having at least a first inductive element positioned in the swimming pool; the recharging base comprising a supporting unit having a first end integral with the swimming pool and a second end which is opposite to the first end and suspended in the swimming pool; the first inductive element hanging from the second end of the supporting unit.

5 Claims, 3 Drawing Sheets

(56) References Cited

U.S. PATENT DOCUMENTS

| | | | | |
|---|---|---|---|---|
| 8,397,330 | B2 * | 3/2013 | Pichon et al. | 15/1.7 |
| 8,661,595 | B2 * | 3/2014 | Bernini | 15/1.7 |
| 2001/0032809 | A1 * | 10/2001 | Henkin et al. | 210/143 |
| 2002/0104790 | A1 * | 8/2002 | Lincke | 210/169 |
| 2003/0201218 | A1 * | 10/2003 | Henkin et al. | 210/169 |
| 2004/0025268 | A1 | 2/2004 | Porat et al. | |
| 2008/0060984 | A1 * | 3/2008 | Henkin et al. | 210/143 |
| 2010/0065482 | A1 * | 3/2010 | Sumonthee | 210/167.1 |
| 2012/0103365 | A1 * | 5/2012 | Sumonthee | 134/18 |
| 2013/0081986 | A1 * | 4/2013 | Gopalan et al. | 210/167.16 |

* cited by examiner

APPARATUS FOR CLEANING SWIMMING POOLS

CROSS-REFERENCE TO RELATED APPLICATION

This Application claims the benefit of priority from European Patent Application No. 12425101.8, filed May 30, 2012, the contents of which are incorporated herein by reference.

FIELD OF THE INVENTION

This invention relates to an apparatus for cleaning swimming pools.

BACKGROUND OF THE INVENTION

Prior art cleaning devices are known comprising self-propelled apparatuses which, after being immersed in a swimming pool, may move on the bottom and on the walls of the swimming pool for cleaning using brushes and a detritus suction circuit.

These devices have turbines which can apply a downward thrust, for maintaining the contact between the device and the surface on which it moves. The inside of the device houses a collection filter which retains all the impurities sucked in.

The self-propelled device is also internally equipped with an electric energy supply unit, designed to supply electricity to electric and electromechanical devices present in the self-propelled device, for example the motors designed to drive the wheels and the turbines, the electronic circuits for detecting impurities, processing the data detected and controlling the various motors, etc.

When the power supply unit, normally a battery or a battery pack, is almost flat, the self-propelled device automatically goes to a recharging base, where the power supply unit can be recharged so that, when a predetermined time has elapsed, it can continue to power swimming pool cleaning work.

There are currently various techniques for recharging the power supply unit mounted on board the self-propelled device.

One of these techniques uses an inductive coupling between a first inductive element which is part of the recharging base, and a second inductive element which is mounted on the self-propelled device and connected to the power supply unit to be recharged.

In this way, when it is the battery recharging condition, the self-propelled device is automatically positioned at an electromagnetic field generated by the first inductive element, to guarantee the transfer of electric energy towards the second inductive element. For this reason, the recharging base is positioned in an area of the swimming pool which can be easily reached by the self-propelled device, normally close to the bottom. In particular, the recharging base is often constrained in a lower area of a side wall of the swimming pool, in such a way as to generate a magnetic field at the bottom and in general in the areas involved in the cleaning operations performed by the self-propelled device.

The base constrained to the wall of the swimming pool is also coupled to a pair of electric cables which are electrically connected to the first inductive element, allowing a predetermined current to flow in the latter, so that power can be transferred to the second inductive element and therefore the battery of the self-propelled device can be recharged.

In general, the electric cables are also constrained to the side wall of the swimming pool and run, in view, from the recharging base (positioned in a lower area) to the outer edge of the swimming pool, where they are suitably connected to the domestic mains.

There are also prior art concealed electric connections extending within the side wall of the swimming pool. In this case, the recharging base is constrained to the side wall of the swimming pool at electric terminals extending from the wall itself.

However, the prior art apparatuses described above have a major disadvantage mainly linked to maintenance operations on the recharging base.

In fact, to work on the first inductive element, it is necessary to operate in the swimming pool to remove the recharging base, with the consequent disadvantages in terms of practicality, often if the water is not removed from the pool to avoid expensive emptying operations.

Moreover, to perform operations for substituting the electrical connections it is necessary to remove from the swimming pool both the base containing the first inductive element and the electric cables suitably constrained to the side wall or, even worse, built into the wall.

Such maintenance operations are therefore complicated and particularly expensive.

SUMMARY OF THE INVENTION

In light of the above, the aim of this invention is to provide an apparatus for cleaning swimming pools which is able to overcome the above-mentioned disadvantages.

In particular, the aim of this invention is to provide an apparatus for cleaning swimming pools which can easily be removed from the swimming pool for any maintenance or substitution operations which may be required.

Another aim of the invention is to provide an apparatus for cleaning swimming pools which is structurally simple and very versatile, especially as regards the position of the recharging base for the self-propelled device.

These and other aims are substantially achieved by an apparatus for cleaning swimming pools as described in the appended claims.

Other features and advantages will become more apparent from the detailed description of a preferred non-limiting embodiment of the invention.

BRIEF DESCRIPTION OF THE DRAWINGS

Said description is provided below with reference to the accompanying drawings, which are also non-limiting and provided by way of example only, in which.

DETAILED DESCRIPTION OF THE INVENTION

Figure 1:
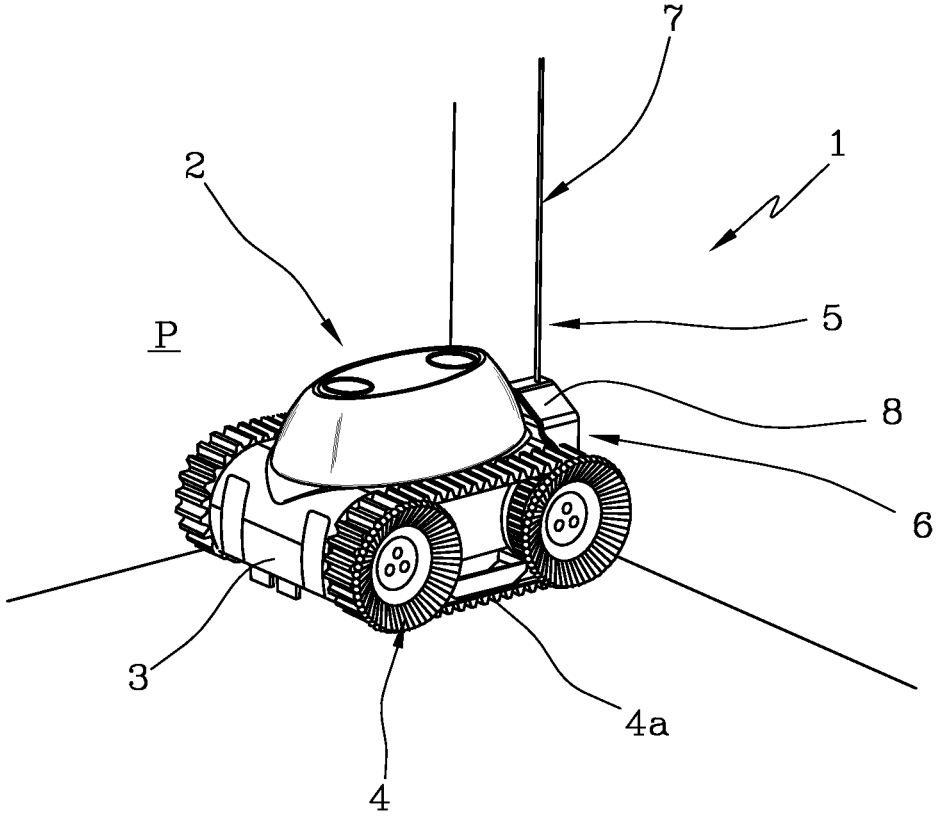
FIG. 1 is a perspective and schematic view of an apparatus in accordance with the invention.
Figure 2:
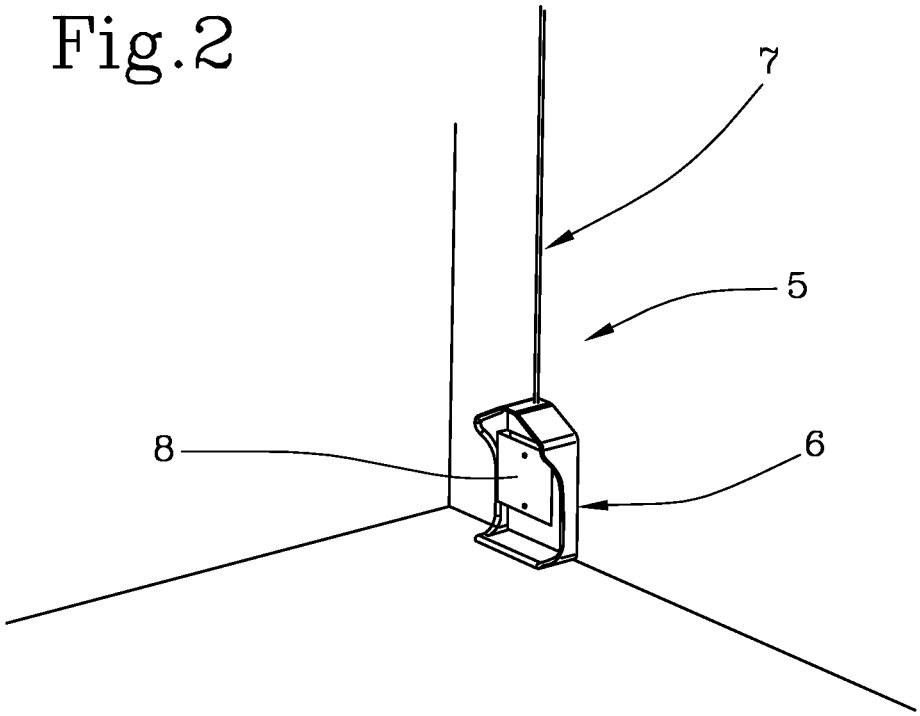
FIG. 2 is a perspective view of a construction detail of the apparatus of FIG. 1.

With reference to the accompanying drawings, the numeral 1 denotes in its entirety an apparatus for cleaning swimming pools according to this invention. The apparatus 1 comprises a self-propelled device 2 housed in a swimming pool "P" which is only partly illustrated and by way of example only in the accompanying drawings.

The self-propelled device 2 comprises a box-shaped frame 3 which is watertight so that it can be immersed in the water and no liquid leaks into it. The frame 3 is supported by movement means 4 for allowing the device 2 to move in the swimming pool "P".

Preferably, the movement means 4 are a pair of tracks 4*a* suitably connected to a motor by transmission units which are not described because they are of the known type and are not part of this invention. The motor which drives the tracks 4*a* is preferably an electric motor positioned inside the frame 3.

The device 2 further comprises a water recirculation circuit and means for cleaning the surfaces of the swimming pool, which are also not described and illustrated in detail because they are of the known type and are not part of this invention. The water recirculation is provided by a set of water inlet ducts, suitably equipped with intake impellers and a system of filters designed to clean the water sucked in. In contrast, the means for cleaning the surfaces comprise a set of brushes which act on the surfaces of the swimming pool to remove any impurities that adhere to said surfaces. All of the device 2 operating units (cleaning means, recirculation circuit and driving motor) are powered by a power supply battery which is also located inside the box-shaped frame 3. The battery is also of the known type and widely used to power the electromechanical units located in the self-propelled device 2.

The apparatus 1 also comprises a recharging base 5 for the power supply battery fitted inside the self-propelled device 2.

In particular, the recharging base 5 comprises a substantially box-shaped supporting body 6, housing a first inductive element 8. As is better illustrated in the accompanying drawings, the supporting body 6 containing the above-mentioned first inductive element 8 is positioned in the swimming pool "P" at the bottom of the pool.

Figure 3:
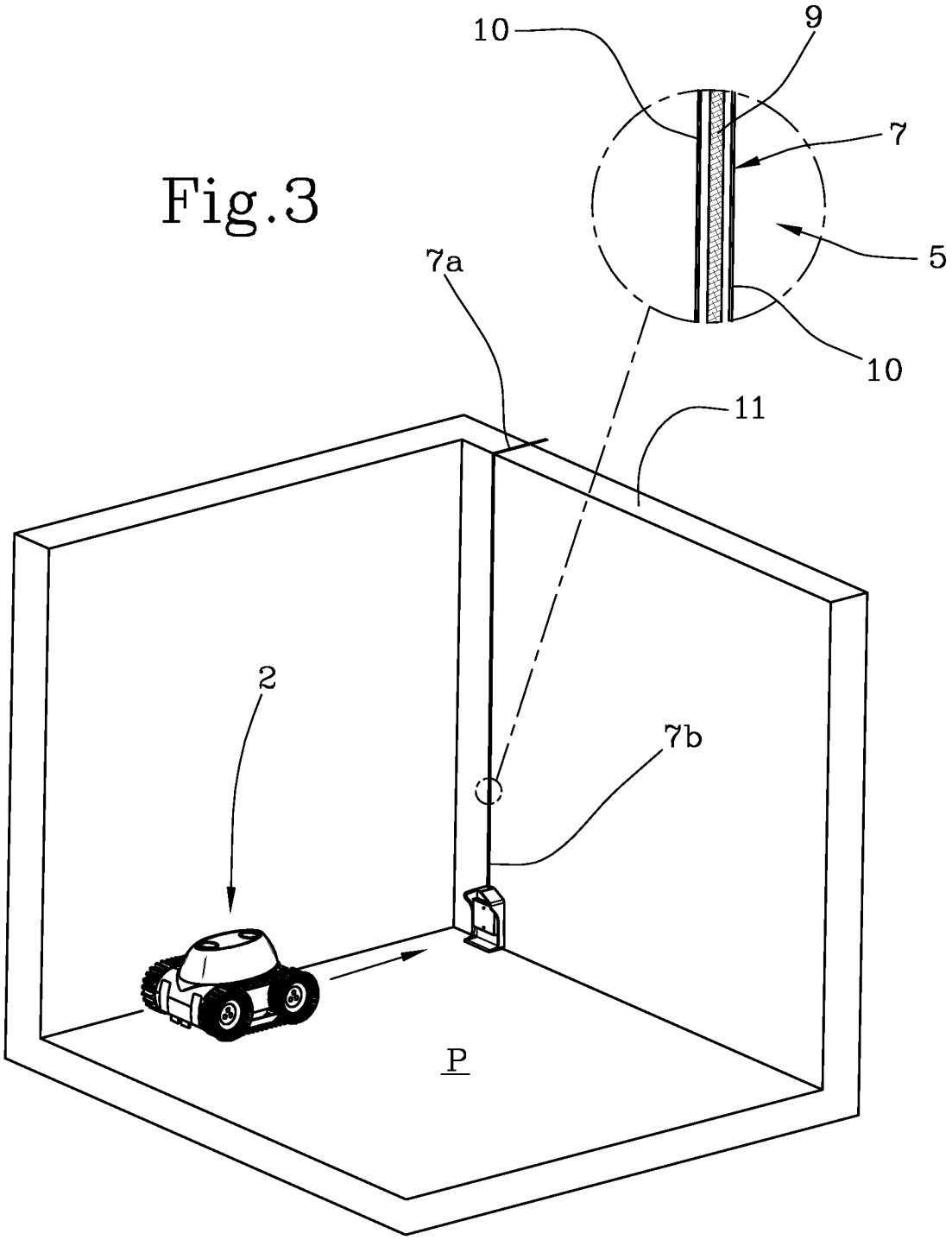
FIG. 3 is a perspective view of the apparatus of FIG. 1 in a respective operating condition.
Figure 4:
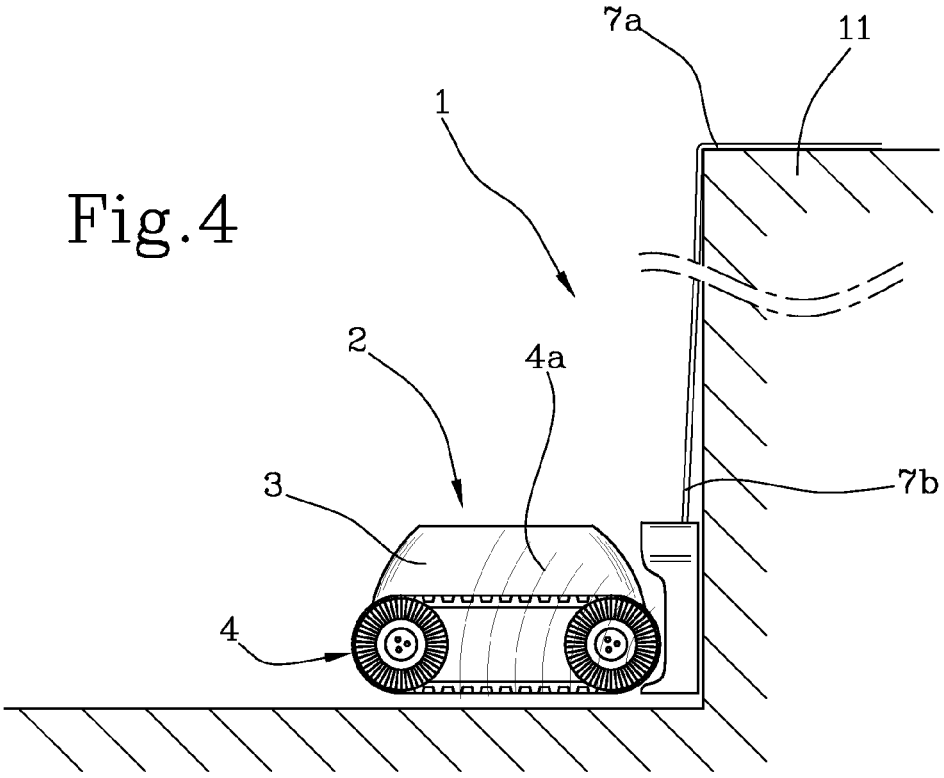
FIGS. 4 and 5 are side and schematic views of the apparatus of FIG. 1 in respective recharging and operating conditions.
Figure 5:
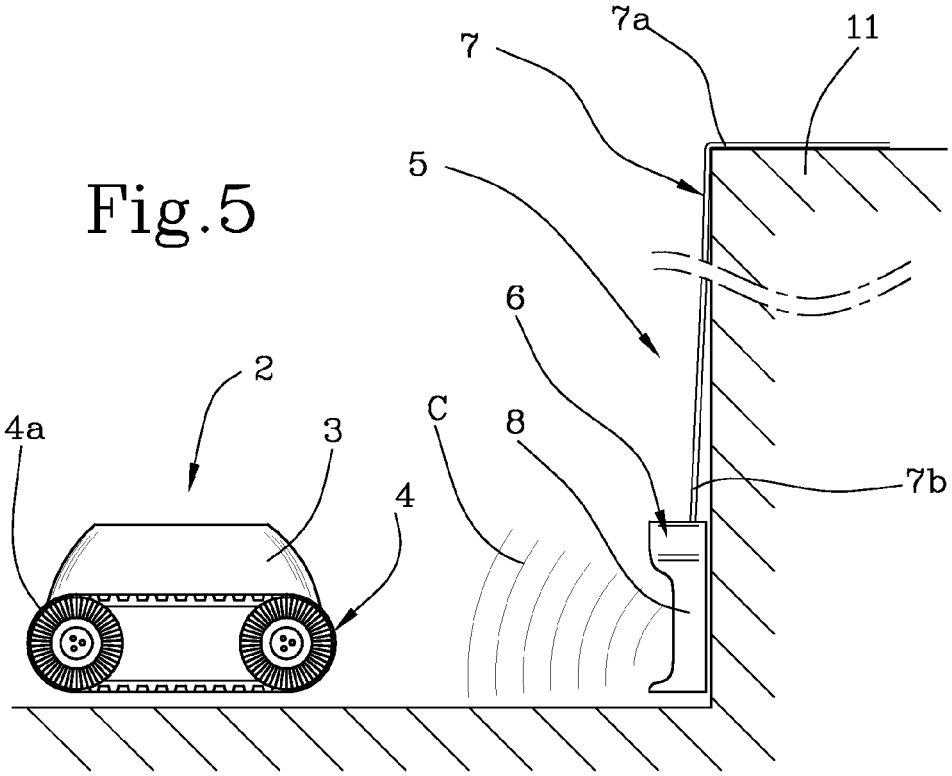

In more detail, the first inductive element 8 is positioned at the bottom so that it can be reached by the self-propelled device 2 and it is alongside a side wall of the swimming pool "P". As shown in FIGS. 4 and 5, the inductive element 8 generates an electromagnetic field "C" at an area of the swimming pool "P" corresponding to an area for recharging the battery of the self-propelled device 2. The recharging base 5 also comprises a supporting unit 7 designed to keep the supporting body 6 hanging in the swimming pool. In particular, the supporting unit 7 comprises a first end 7*a* integral with the swimming pool "P" and a second end 7*b*, opposite to the first end 7*a*, and suspended in the swimming pool (FIGS. 3 to 5).

As shown in the accompanying drawings and described above, in this situation the first inductive element 8 contained in the supporting body 6 is hanging from the second end 7*b* of the supporting unit 7. In other words, the first inductive element 8 is not constrained to or engaged with the walls or the bottom of the swimming pool "P", but is left hanging from the edge of the swimming pool "P" towards an area that can be reached by the self-propelled device 2.

Advantageously, the first end 7*a* of the supporting unit 7 engages with the outer edge 11 of the swimming pool "P" by means of suitable hooking systems which are known and are not described in detail. In this situation, the supporting unit 7 extends vertically along a side wall of the swimming pool "P" so that the first inductive element 8 dangles at the bottom of the swimming pool "P".

According to another embodiment, not illustrated in the accompanying drawings, the first end 7*a* of the supporting unit 7 engages with the side wall of the swimming pool "P" at a predetermined height, instead of engaging with the edge 11. Even in this situation the first inductive element 8 is in any case left dangling in the swimming pool "P" close to the bottom.

With reference to FIG. 3, it should be noticed that the supporting unit 7 advantageously comprises a connecting rope 9 made of substantially flexible material and having an upper end corresponding to the above-mentioned first end 7*a* and a lower end corresponding to the second end 7*b*.

Extending alongside the rope 9 there is also one or more pairs of electric cables 10 for supplying power to the first inductive element 8 and if necessary for transporting a communication signal between the inductive part which is underwater and the power supplier which is outside the swimming pool.

As illustrated in the enlarged detail in FIG. 3, each cable 10 extends parallel with and along the rope 9.

It should be noticed that the cables 10 electrically connect the first inductive element 8 with a domestic mains electricity network.

Since the cables 10 are low voltage, there must be a suitable transformer between them and the connection to the domestic mains outside the swimming pool.

The cables 10 are not designed to support the body 6. Said body only hangs from the connecting rope 9. Moreover, according to a further embodiment, not illustrated, the supporting unit 7 could be enclosed in a sheath, in which the cables 10 and the rope 9 extend. In this way, the sheath would hide from view the components of the entire supporting unit 7.

As shown in FIGS. 4 and 5, the self-propelled device 2 can be switched between an operating condition in which it is distanced from the recharging base 5 for performing cleaning operations in the swimming pool "P", and a non-operating condition in which it is brought close to the base 5. In the non-operating condition (FIG. 4), the self-propelled device 2 is automatically brought within the magnetic field "C" generated by the first inductive element 8. Consequently, in this condition electric energy is transferred from the first inductive element 8 to a second inductive element positioned inside the device 2 frame 3 and suitably associated with the battery.

Advantageously, when the battery is almost flat, a device 2 electronic management system issues a command to the movement means 4 to return the device 2 to the recharging base 5.

Once it is within the electromagnetic field "C", the second inductive element therefore transfers the electric energy to the battery.

The invention brings important advantages.

In fact, if maintenance work must be carried out on the entire apparatus 1, the recharging base 5 can easily be removed from the swimming pool "P" thanks to the presence of the supporting unit 7.

In fact, since the supporting body 6 is immersed in such a way that it is hanging down in the pool, the operator can simply use the rope 9 to lift the body 6 and take it out of the swimming pool "P".

Said action is due to the fact that the recharging base 5 is not constrained to the bottom of the swimming pool or to the side wall, but instead dangles from the rope 9.

Advantageously, maintenance and substitution operations on the recharging base 5 are particularly fast and inexpensive. It should also be noticed that the base 5 is structurally simple and its use does not necessitate further operations for installation and hooking to the bottom of the swimming pool "P".

The invention claimed is:

1. An apparatus for cleaning swimming pools, comprising:

a self-propelled device comprising:

movement means for moving said device in a swimming pool;

a water recirculation circuit;

means for cleaning the surfaces of the swimming pool; and a power supply battery for supplying electric energy to one or more of the movement means, the recirculation circuit and the cleaning means; and a recharging base for said power supply battery, the recharging base being separate from the self-propelled device and comprising a box-shaped supporting body capable of being positioned in the swimming pool, the box-shaped supporting body housing a first inductive element for wirelessly transferring electrical energy to the power supply of the self-propelled device;

wherein the recharging base comprises a supporting unit designed to keep the supporting body hanging in the swimming pool and positioned towards the bottom of the swimming pool, the supporting unit including a first end integral with the swimming pool and a second end opposite to the first end and suspendable in the swimming pool, and the supporting body containing the first inductive element hanging from the second end of the supporting unit;

wherein the supporting unit comprises a connecting rope made of substantially flexible material having an upper end corresponding to the first end of the supporting unit and a lower end corresponding to the second end of the supporting unit, and at least one pair of electric cables for supplying power to the first inductive element, each cable extending along the connecting rope, wherein the cables being not designed to support the supporting body whereby the supporting body hanging only hangs from the connecting rope.

2. The apparatus according to claim 1, wherein the first end of the supporting unit engages with the outer edge of the swimming pool and also wherein the supporting unit extends vertically along a side wall of the swimming pool; the first inductive element dangling at the bottom of the swimming pool.

3. The apparatus according to claim 1, wherein the first end of the supporting unit engages with a side wall of the swimming pool and also wherein the supporting unit extends vertically along said side wall; the first inductive element dangling at the bottom of the swimming pool.

4. The apparatus according to claim 1, wherein the self-propelled device can be switched between an operating condition in which it is distanced from the recharging base for cleaning the swimming pool, and a non-operating condition in which it is brought close to the recharging base to allow the transfer of electric energy from the first inductive element to the power supply battery.

5. The apparatus according to claim 1, wherein the power supply battery comprises a second inductive element; with the self-propelled device in the non-operating condition, said second inductive element being positioned within an electromagnetic field generated by the first inductive element for electrically charging the battery.

* * * * *